US008970338B2

(12) United States Patent
Johnson

(10) Patent No.: US 8,970,338 B2
(45) Date of Patent: Mar. 3, 2015

(54) TRANSFORMER HAVING A CORE FRAME WITH INTERLOCKING MEMBERS

(75) Inventor: Charles W. Johnson, Wytheville, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/981,345

(22) PCT Filed: Jan. 24, 2012

(86) PCT No.: PCT/US2012/022346

§ 371 (c)(1),
(2), (4) Date: Jul. 24, 2013

(87) PCT Pub. No.: WO2012/103078

PCT Pub. Date: Aug. 2, 2012

(65) Prior Publication Data

US 2013/0307659 A1 Nov. 21, 2013

Related U.S. Application Data

(60) Provisional application No. 61/436,469, filed on Jan. 26, 2011.

(51) Int. Cl.

| | |
|---|---|
| ***H01F 27/26*** | (2006.01) |
| ***H01F 27/24*** | (2006.01) |
| ***H01F 30/12*** | (2006.01) |
| ***H01F 27/28*** | (2006.01) |
| ***H01F 3/08*** | (2006.01) |
| ***H01F 41/02*** | (2006.01) |

(52) U.S. Cl.
CPC ..... *H01F 27/263* (2013.01); *H01F 41/02* (2013.01)
USPC ..... 336/210; 336/214; 336/5; 336/184; 29/606

(58) Field of Classification Search
USPC ..... 336/210, 170, 5, 184
See application file for complete search history.

(56) References Cited

U.S. PATENT DOCUMENTS

| | | | | |
|---|---|---|---|---|
| 2,372,067 A * | 3/1945 | Forbes | 336/210 |
| 3,374,453 A * | 3/1968 | Broverman et al. | 336/197 |
| 4,075,590 A | 2/1978 | Foldes | |
| 5,359,314 A * | 10/1994 | McQuay et al. | 336/192 |
| 7,623,016 B2 * | 11/2009 | Shudarek et al. | 336/210 |

FOREIGN PATENT DOCUMENTS

| | | |
|---|---|---|
| JP | 03-032007 A * | 2/1991 |
| JP | 6188128 A | 7/1994 |

* cited by examiner

*Primary Examiner* — Mangtin Lian
(74) *Attorney, Agent, or Firm* — Melissa J. Szczepanik

(57) ABSTRACT

A distribution transformer having a slot-and-tab core frame assembly. The core frame (17) encloses a transformer core (11) having at least one phase and provides compression on the core yokes and end members of the transformer to bind the assembly together. First and second clamps (10, 24) of the core frame contain receiving slots (34) for the tabbed (18, 28), longitudinal side supports (20), creating an interlock when connected. For larger transformers, the tabbed side supports may be alternatively comprised of a subassembly of end plates, cams, and tabbed locking plates, encompassing a sturdy locking mechanism.

20 Claims, 2 Drawing Sheets

FIG. 5
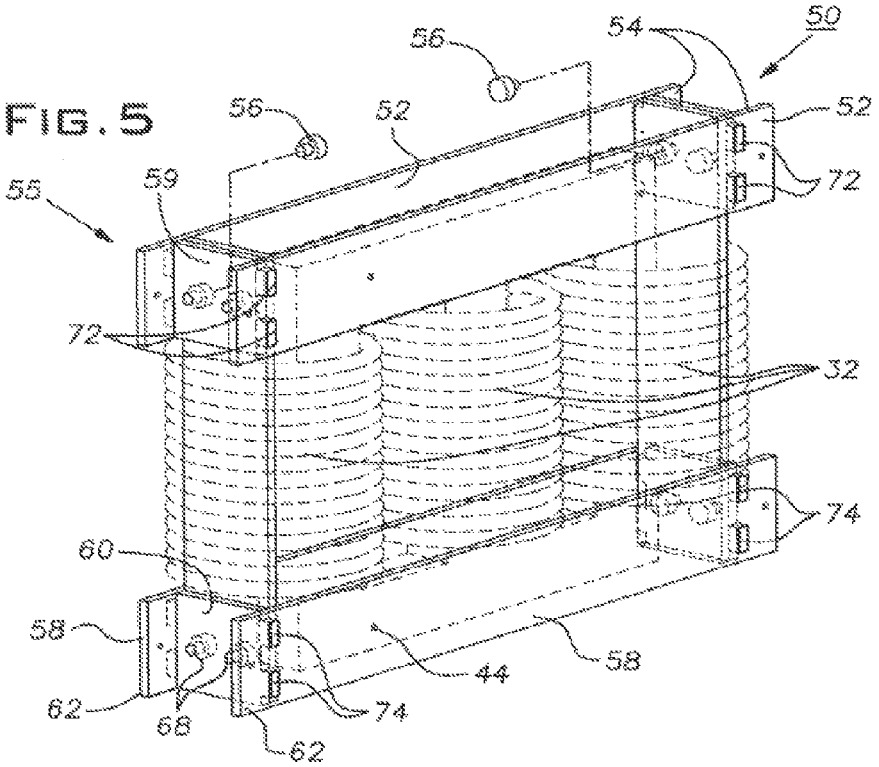
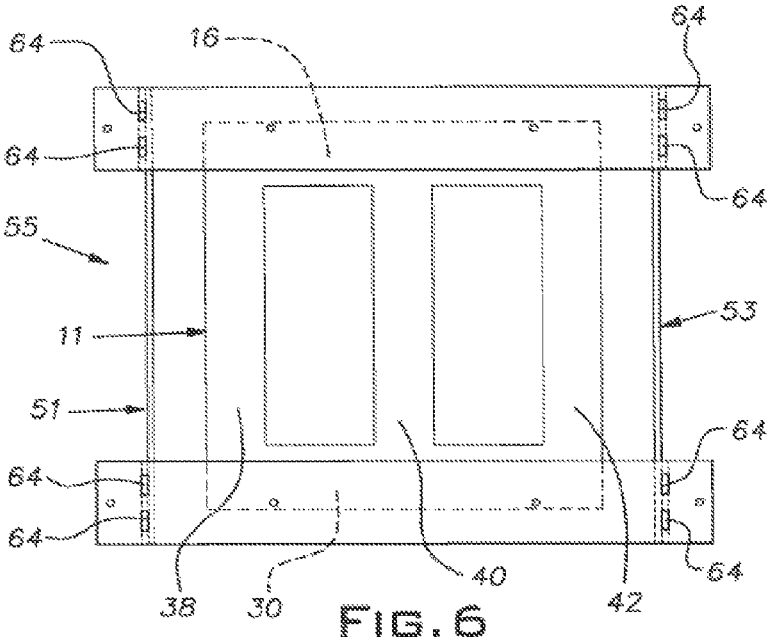
FIG. 6
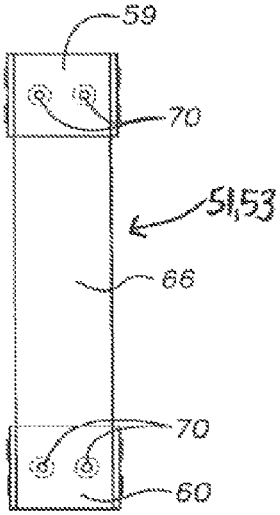
FIG. 7

TRANSFORMER HAVING A CORE FRAME WITH INTERLOCKING MEMBERS

FIELD OF INVENTION

The present application is directed to transformers and, more particularly, to supports for cores of transformers.

BACKGROUND

A frame for a core of a distribution transformer serves the purpose of clamping and compressing top and bottom yokes of the core, thereby holding the core together. The construction of a conventional transformer core frame typically involves bolting, welding, or dowel pinning to achieve mechanical interlocking of component members of the core frame. The production of such core frames is costly and labor intensive. Accordingly, there is a need for a new type of core frame that is simpler and easier to produce. The present invention is directed to such an improved core frame.

SUMMARY

The present invention is directed to a distribution transformer with a slot-and-tab interlocking core frame. The core frame encloses a ferromagnetic core having one or more core limbs. The core frame is formed of first and second clamps and side supports. The first clamp of the core frame has two plates positioned parallel to one another and compresses a first yoke of the core. The second clamp of the core frame has two plates positioned parallel to one another and compresses a second yoke of the core. Each of the plates in the first and second clamps has a slot formed in each opposing end portion.

The side supports of the core frame each have a first and second end portion having tabs extending outwardly from the sides. The core frame is assembled by positioning the tabs of the second end portion of each side support into the receiving slots of the second clamp. The coil assemblies are placed over each core limb and when more than one core limb is present, the outer core limbs and side supports together receive a coil assembly. The tabs of the first end portion of each side support are placed into the receiving slots of the first clamp and an interlock is created between the clamps and side supports, holding the core frame together.

For larger transformers, the side supports should be capable of holding more weight. The side supports in heavier transformers may be assembled using locking plates, cams and main plates to strengthen the core frame. The locking plates have holes formed near the center. The main plate has holes formed near each opposing end. Each side support has two locking plates fastened to a main plate using four cams. Each cam has two circular ends with different circumferences. The cam ends having a larger circumference are placed into the main plate openings. The cam ends having a smaller circumference are placed into the locking plate openings. The cams fasten the locking plates to the main plate to form an assembled side support.

Once assembled, the side supports of the strengthened core frame have two tabs extending outwardly from each opposing edge and therefore, the first and second plates each have two corresponding slots on each opposing end to receive the tabs. The core frame is assembled by positioning the tabs of the second ends of the side supports into the corresponding receiving slots of the plates of the second clamp. The coil assemblies are placed over each core limb and when more than one core limb is present, the outer core limbs and side supports together receive a coil assembly. The tabs of the first ends of the side supports are placed into the corresponding receiving slots of the plates of the first clamp, and an interlock is formed, binding the core frame together.

BRIEF DESCRIPTION OF THE DRAWINGS

In the accompanying drawings, structural embodiments are illustrated that, together with the detailed description provided below, describe exemplary embodiments of a distribution transformer having a slot-and-tab interlocking core frame. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures may not be drawn to scale and the proportions of certain parts may have been exaggerated for convenience of illustration.

FIG. 5 is a front perspective view of a second distribution transformer having a second core frame constructed in accordance with a second embodiment of the present invention;

FIG. 6 is a front view of the second distribution transformer, having the coil windings removed and a portion of the core in phantom; and FIG. 7 is a side view of the second distribution transformer of FIG. 6, showing an assembled side support of the core frame, the side support comprising a main plate, cams and locking plates.

DETAILED DESCRIPTION

Figure 1:
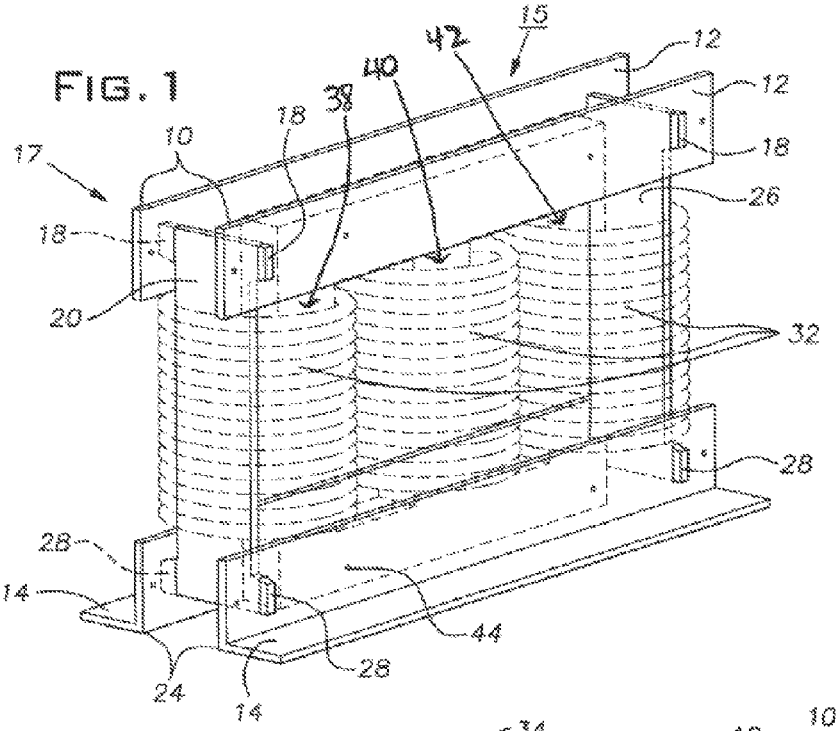
FIG. 1 is a front perspective view of a first distribution transformer having a first core frame constructed in accordance with a first embodiment of the present invention.

In the present invention, slot-and-tab interlocking replaces the labor-intensive aspects of bolting or welding and results in less production time required for core frame assembly. The present invention also reduces the number of pieces required in the assembly. The slot-and-tab interlocking mechanism is useful in smaller, lower weight transformers, whereas an embodiment of the slot-and-tab transformer core frame utilizing a support member subassembly having main plates, cams, and locking plates is preferred in larger, heavier transformers. Lower cost and less labor in frame assembly are the major objectives of this invention.

The present invention is directed to a distribution transformer 15, 50 having a core 11 supported by an improved core frame 17 of the present invention. The distribution transformer 15, 50 may be single phase or poly-phase (e.g. three phases). In addition, the distribution transformer 15, 50 may be dry or fluid-filled. If the distribution transformer 15, 50 is fluid-filled, the distribution transformer includes a tank filled with a dielectric fluid in which the core and the core frame are disposed. The core 11 of the distribution transformer 15, 50 is comprised of thin, stacked laminations of magnetically permeable material, such as grain-oriented silicon steel or amorphous metal. The laminations are typically arranged in stacks such that the core has one or more legs or limbs disposed vertically between a pair of yokes disposed horizontally. In a three-phase transformer, the core limbs and yokes typically connect to form a pair of core windows. A coil assembly 32 is disposed around each core limb, and comprises primary and secondary coil windings. The primary and secondary coil windings are often arranged concentrically along the length of the core limbs. Alternatively, the primary and secondary windings may be mounted one above the other along the length of each core limb. The windings 32 fill the core window as completely as possible without allowing the contact of adjacent windings. The transformer core is enclosed within the core frame.

Referring now to FIG. 1, there is shown a first distribution transformer 15 constructed in accordance with a first embodiment of the present invention. The first distribution transformer 15 has a first core frame 17 that is comprised of first and second clamps 10, 24 and first and second side supports 20, 26. The first and second clamps 10, 24 and the first and second side supports 20, 26 may be constructed from a different material than the core 11. For example, the first and second clamps 10, 24 and the first and second side supports 20, 26 may be comprised of regular, non-electrical grade carbon steel, which has different magnetic properties than grain-oriented silicon steel or amorphous metal. The first clamp 10 of the first core frame comprises a pair of first plates 12, each of which has opposing end portions. A receiving slot 34 is formed in each of the end portions. The first plates 12 are positioned parallel to one another, one on each side of a first yoke 16 of the core 11. The first clamp 10 contacts and compresses the first yoke 16 of the core, as shown in FIG. 1.

The second clamp 24 of the first core frame 17 comprises a pair of second plates 14, each of which has opposing end portions. A receiving slot 34 is formed in each of the end portions. The second plates 14 are positioned parallel to one another, one on each side of a second yoke 30 of the core 11. The second clamp 24 contacts and compresses the second yoke 30 of the core.

Figure 2:
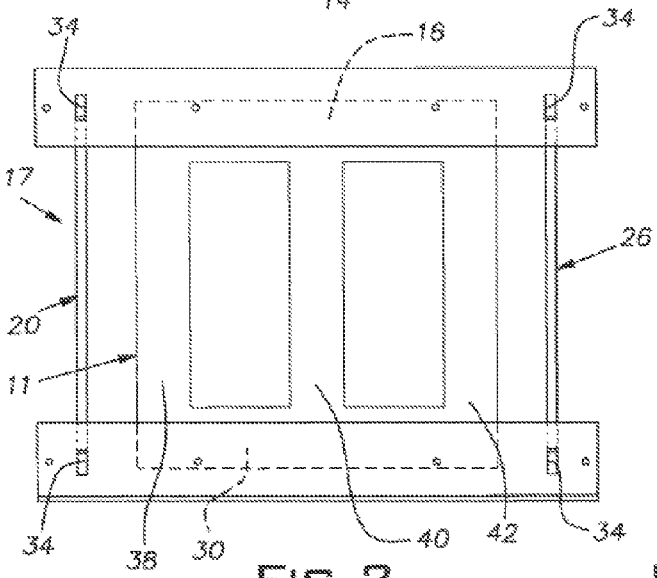
FIG. 2 shows a front view of the first distribution transformer, with the coil windings removed and a portion of the core in phantom.

Referring now to FIG. 2, a front view of the first core frame 17 is shown with the coil windings 32 removed and a portion of the core 11 in phantom. The first and second plates 12, 14 have receiving slots on each opposing end and surround the first and second yokes 16, 30, respectively. The core limbs 38, 40, 42 are disposed between the yokes 16, 30. In order to maintain the compression of the first and second clamps 10, 24 on the core 11, the first and second plates 12, 14 have holes 44 to receive bolts, dowel pins or welded pieces.

Figure 3:
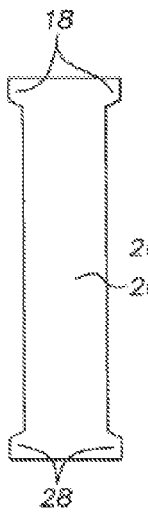
FIG. 3 is a side view of one of the side supports of the first core frame.

The first core frame has a first side support 20 and a second side support 26 as previously described. Referring now to FIG. 3, a side support 20 or 26 is shown in detail having first tabs 18 and second tabs 28. Each side support has opposing side edges and opposing first and second end portions. The first end portion of each side support has first tabs 18 extending outwardly from the side edges. The second end portion of each side support has second tabs 28 extending outwardly from the side edges.

Figure 4:
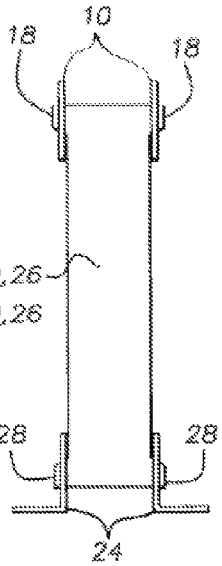
FIG. 4 is a side view of the first distribution transformer of FIG. 2 showing the connection between the tabs of one of the side supports and clamps of the first core frame.

The first core frame is assembled by placing the second tabs 28 of the first and second side supports 20, 26 into the receiving slots 34 of the second plates of the second clamp, compressing the second yoke 30 of the core. The coil assemblies 32, comprised of primary and secondary windings, are placed over the core limbs 38, 40, 42. As shown in FIG. 1, the outer core limbs 38, 42 and side supports 20, 26 make contact and together receive coil assemblies. The first tabs 18 of the first and second side supports are placed into the receiving slots 34 of the first plates 12 of the first clamp, compressing the first yoke 16 of the core. Referring now to FIG. 4, a side view of the connection between the tabs 18, 28 of a side support and the slots 34 of the clamps is shown.

Referring now to FIG. 5, there is shown a second distribution transformer 50 constructed in accordance with a second embodiment of the present invention. The second distribution transformer has a second core frame 55 that is comprised of first and second clamps 54, 62 and first second side supports 51, 53. The first and second clamps 54, 62 and the first and second side supports 51, 53 may be constructed from a different material than the core 11, in the same manner as described in the first distribution transformer 15. The first clamp 54 of the second core frame 55 comprises a pair of first plates 52, each of which has opposing end portions. Two receiving slots 64 are formed in each of the end portions. The first plates 52 are positioned parallel to one another, one on each side of the first yoke 16. The first clamp 54 contacts and compresses the first yoke 16 of the core 11, as shown in FIG. 5.

The second clamp 62 of the second core frame 55 comprises a pair of second plates 58, each of which has opposing end portions. Two receiving slots 64 are formed in each of the end portions. The second plates 58 are positioned parallel to one another, one on each side of the second yoke 30. The second clamp 62 contacts and compresses the second yoke 30 of the core 11.

The second core frame 55 has two side supports, a first side support 51 and a second side support 53 as shown in FIG. 5. The side supports 51, 53 of the second core frame 55 are each comprised of first and second locking plates 59, 60 connected to a main plate 66. The side supports 51, 53 are assembled by connecting the main plate 66 to the first and second locking plates 59, 60 using cams 56, each having circular ends of different circumferences. A first end of each cam 56 has a larger circumference than a second end. The main plate 66 has opposing end portions wherein at least two openings 70 are formed in each end portion for receiving the first end of the cams 56. Each of the locking plates 59, 60 has at least two openings 68 formed near the center for receiving the second end of the cams 56. The cams 56 fasten the locking plates 59, 60 and main plate 66 together to form a side support. After assembly, the side supports 51, 53 of the second core frame have two opposing end portions with two tabs extending from each side edge, resulting in a first end portion having four first tabs 72 and a second end portion having four second tabs 74.

Referring now to FIG. 7, a side view of a side support 51 or 53 is shown, having first and second locking plates 59, 60 fastened to a main plate 66 using four cams 56. As the weight of the transformer increases, it may be necessary to increase the number of cams on each end of the first and second side supports to three or four. The increased contact surface area provided by adding additional cams may result in a sturdier interlock for the core frame. In the same manner, the number of tabs 72, 74 on each side edge of the first and second ends of the side supports 51, 53 and the corresponding number of slots 64 formed in each opposing end of the first and second plates 52, 58, may be increased as the weight of the transformer increases.

The second core frame 55 is assembled by placing the four second tabs 74 of the first and second side supports 51, 53 into the receiving slots 64 of the second plates 58 of the second clamp 62, compressing the second yoke 30 of the core 11. The coil assemblies 32, comprised of primary and secondary windings are placed over the core limbs 38, 40, 42. As shown in FIG. 5, the outer core limbs 38, 42 and side supports 51, 53 make contact and together receive the coil assemblies 32. The four first tabs 72 of the assembled first and second side supports 51, 53 are placed into the receiving slots 64 of the first plates 52 of the first clamp 54, compressing the first yoke 16 of the core 11.

While the present application illustrates various embodiments of a distribution transformer having a slot-and-tab interlocking core frame, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A distribution transformer comprising: a ferromagnetic core comprising at least one limb extending between first and second yokes; at least one coil assembly mounted to at least one limb; a frame for holding the core, the frame comprising: a first clamp comprising a pair of first plates having the first yoke disposed between the pair of first plates, each of the first plates having opposing end portions, each of the first plate end portions having a slot formed therein; a second clamp comprising a pair of second plates having the second yoke disposed between the pair of second plates, each of the second plates having opposing end portions, each of the second plate end portions having a slot formed therein; first and second side supports, each of the first and second side supports having opposing side edges and opposing first and second end portions, the first end portion having first tabs extending outwardly from the side edges respectively, and the second end portion having second tabs extending outwardly therefrom, respectively; and wherein the first tabs of the first and second side supports are disposed in the slots of the first plates of the first clamp, respectively, and the second tabs of the first and second side supports are disposed in the slots of the second plates of the second clamp, respectively, the first and second tabs extending outwardly when engaged with corresponding ones of the slots.

2. The distribution transformer of claim 1, wherein each of the first and second side supports is in contact with at least one limb of the core.

3. The distribution transformer of claim 2, wherein at least one limb comprises first and second limbs, and wherein the first side support is in contact with the first limb and the second side support is in contact with the second limb.

4. The distribution transformer of claim 3, wherein at least one limb further comprises a third limb disposed between the first and second limbs.

5. The distribution transformer of claim 4, wherein at least one coil assembly comprises first, second and third coil assemblies mounted to the first, second and third limbs, respectively.

6. The distribution transformer of claim 5, wherein the first support extends through the first coil assembly and the second support extends through the second coil assembly.

7. The distribution transformer of claim 6, wherein each of the first, second and third coil assemblies comprises a primary winding disposed around a secondary winding.

8. The distribution transformer of claim 3, wherein the first and second yokes and the first, second and third limbs are each comprised of a stack of laminations.

9. The distribution transformer of claim 8, wherein the first plates, the second plates and the first and second side supports of the frame are each composed of a material having different magnetic properties than the laminations of the core.

10. The distribution transformer of claim 9, wherein the laminations of the core are composed of grain-oriented silicon steel, and wherein the first plates, the second plates and the first and second side supports of the frame are composed of regular carbon steel.

11. The distribution transformer of claim 1, wherein in each of the first and second side supports, the first end portion has two first tabs extending outwardly from each of the side edges, and the second end portion has two second tabs extending outwardly from each of the side edges, and thus, the first end portion comprises four first tabs and the second end portion comprises four second tabs; wherein in the first clamp, each of the first plates has two slots formed in each end portion; wherein in the second clamp, each of the second plates has two slots formed in each end portion; and wherein the four first tabs of the first side support are disposed in the slots in first ends of the first plates of the first clamp, respectively, and the four first tabs of the second side support are disposed in the slots in second ends of the first plates of the first clamp; and wherein the four second tabs of the first side support are disposed in the slots in first ends of the second plates of the second clamp, respectively, and the four second tabs of the second side support are disposed in the slots in second ends of the second plates of the second clamp, respectively.

12. The distribution transformer of claim 11, wherein each of the first and second side supports comprises first and second locking plates fastened to a main plate.

13. The distribution transformer of claim 1, wherein each of the first and second side supports comprises first and second locking plates fastened to a main plate.

14. The distribution transformer of claim 13, wherein in each of the first and second side supports, the first locking plate comprises the first tabs and the second locking plate comprises the second tabs.

15. The distribution transformer of claim 12, wherein in each of the first and second side supports, the first and second locking plates are each fastened to the main plate by one or more cams, each cam comprising circular first and second ends.

16. The distribution transformer of claim 15, wherein with regard to each of the first and second locking plates, each cam is arranged such that the first end is disposed in an opening in the main plate and the second end is disposed in an opening in the locking plate.

17. The distribution transformer of claim 16, wherein in each cam, the first end has a larger circumference than the second end.

18. A method of forming a distribution transformer, comprising: a. providing a ferromagnetic core comprising at least one limb extending between first and second yokes; b. forming a frame for holding the core, comprising: providing first and second side supports, each of the first and second side supports having opposing side edges and opposing first and second end portions, the first end portion having first tabs extending outwardly from the side edges respectively, and the second end portion having second tabs extending outwardly therefrom, respectively; providing a pair of first plates, each of the first plates having opposing first and second end portions, each of the first plate first and second end portions having a slot formed therein; providing a pair of second plates, each of the second plates having opposing first and second end portions, each of the second plate first and second end portions having a slot formed therein; placing one of the first plates on one side of the first yoke; placing the other one of the first plates on the other side of the first yoke; placing one of the second plates on one side of the second yoke; placing the other one of the second plates on the other side of the second yoke; placing one of the first tabs of the first side support into the slot in the first end portion of one of the first plates; placing the other one of the first tabs of the first side support into the slot in the first end portion of the other one of the first plates; placing one of the first tabs of the second side support into the slot in the second end portion of one of the first plates; placing the other one of the first tabs of the second side support into the slot in the second end portion of the other one of the first plates; placing one of the second tabs of the first side support into the slot in the first end portion of one of the second plates; placing the other one of the second tabs of the first side support into the slot in the first end portion of the other one of the second plates; placing one of the second tabs of the second side support into the slot in the second end portion of one of the first plates; and placing the other one of the second tabs of the second side support into the slot in the second end portion of the other one of the second plates, the first and second tabs extending outwardly when engaged with corresponding ones of the slots; and c. mounting at least one coil assembly to at least one limb.

19. The method of claim 18, wherein at least one limb comprises first, second and third limbs, and at least one coil assembly comprises first, second and third coil assemblies, and wherein the step of mounting at least one coil assembly comprises mounting the first, second and third coil assemblies to the first, second and third limbs, respectively.

20. The method of claim 19, wherein the mounting of the first coil assembly comprises placing the first coil assembly over the first limb and the first side support; and wherein the mounting of the second coil assembly comprises placing the second coil assembly over the second limb and the second side support.

* * * * *